US006523375B2

(12) United States Patent
Beatty

(10) Patent No.: US 6,523,375 B2
(45) Date of Patent: Feb. 25, 2003

(54) DEADBOLT THUMBTURN ASSEMBLY

(75) Inventor: Christopher N. Beatty, Colorado Springs, CO (US)

(73) Assignee: Schlage Lock Company, Indianapolis, IN (US)

( * ) Notice: Subject to any disclaimer, the term of this patent is extended or adjusted under 35 U.S.C. 154(b) by 13 days.

(21) Appl. No.: 09/781,101

(22) Filed: Feb. 9, 2001

(65) Prior Publication Data

US 2002/0108409 A1 Aug. 15, 2002

(51) Int. Cl.[7] ..... E05B 65/06

(52) U.S. Cl. ..... 70/134; 70/416; 292/1.5; 292/348; 292/349; 292/358; 292/359; 292/336.3

(58) Field of Search ..... 70/134, 416; 292/358, 292/359, 349, 336.3, 348, 1.5

(56) References Cited

U.S. PATENT DOCUMENTS

| | | | | | |
|---|---|---|---|---|---|
| 487,416 | A | * | 12/1892 | Case | 292/349 |
| 736,290 | A | * | 8/1903 | Noack | 292/349 |
| 858,396 | A | * | 7/1907 | Issleib | 292/349 |
| 1,663,417 | A | * | 3/1928 | Schunck et al. | 292/355 |
| 2,296,020 | A | * | 9/1942 | Carter | 292/139 |
| 4,047,408 | A | * | 9/1977 | Johns et al. | 70/129 |
| 4,055,361 | A | * | 10/1977 | Moses | 292/359 |
| 4,338,804 | A | | 7/1982 | Solorieff | |
| 4,453,753 | A | * | 6/1984 | Fayerman et al. | 292/348 |
| 4,588,221 | A | * | 5/1986 | Miller et al. | 292/348 |
| 4,656,849 | A | * | 4/1987 | Rotondi et al. | 70/134 |
| 4,746,155 | A | * | 5/1988 | Hart | 292/351 |
| 4,756,178 | A | * | 7/1988 | Shen | 70/380 |
| 4,876,866 | A | * | 10/1989 | Fleming et al. | 70/379 R |
| 5,009,089 | A | * | 4/1991 | Lin | 70/114 |
| 5,083,823 | A | * | 1/1992 | Fann et al. | 292/359 |
| 5,249,444 | A | * | 10/1993 | Dancs | 70/380 |
| 5,291,767 | A | * | 3/1994 | Weindorf et al. | 70/370 |
| 5,335,525 | A | | 8/1994 | Solovieff | |
| 5,505,508 | A | * | 4/1996 | Kuo | 292/359 |
| 5,540,070 | A | | 7/1996 | Adelmeyer | |
| 5,556,144 | A | * | 9/1996 | Lin | 292/336.3 |
| 5,689,984 | A | * | 11/1997 | Diculescu et al. | 11/97 |
| 5,695,227 | A | | 12/1997 | Smallegan et al. | |
| 5,761,937 | A | | 6/1998 | Adelmeyer | |
| 5,765,412 | A | | 6/1998 | Koskela et al. | |
| 5,787,741 | A | * | 8/1998 | Shen | 70/107 |
| 5,901,590 | A | * | 5/1999 | Lai | 70/416 |
| 5,906,125 | A | | 5/1999 | Shen | |
| 5,927,776 | A | * | 7/1999 | Kiss | 292/348 |
| 5,950,467 | A | * | 9/1999 | Dong | 70/467 |
| 6,029,484 | A | * | 2/2000 | Jetton | 70/371 |
| 6,145,358 | A | * | 11/2000 | Wu | 70/467 |
| 6,164,099 | A | * | 12/2000 | Sh | 70/134 |
| 6,230,528 | B1 | | 5/2001 | Don et al. | |

FOREIGN PATENT DOCUMENTS

| | | | |
|---|---|---|---|
| JP | 9317267 | * | 9/1997 |

* cited by examiner

*Primary Examiner*—William L. Miller
*Assistant Examiner*—Carlos Lugo
(74) *Attorney, Agent, or Firm*—Michael Best & Friedrich LLP

(57) ABSTRACT

The deadbolt thumbturn assembly of the present invention includes a thumbturn including a thumbturn extension, which is inserted through a bushing collar and rose bearing, then secured with a retaining ring such that the thumbturn extension is able to rotate within the bushing collar. The threaded bushing collar is then inserted through the aperture of the deadbolt rose and secured with a retaining ring forming a deadbolt thumbturn assembly such that the threaded bushing collar is able to rotate with respect to the deadbolt rose. The thumbturn assembly is then attached to the deadbolt lock by fastening the bushing collar to the threaded boss of the inside housing and inserting the extension of the deadbolt actuator into a receptacle of the thumbturn.

12 Claims, 4 Drawing Sheets

DEADBOLT THUMBTURN ASSEMBLY

TECHNICAL FIELD

The present invention relates to a thumbturn assembly for use with a single cylinder deadbolt lock, and method of assembly. More particularly, the present invention is a thumbturn assembly and method which allows for forged brass trim, concealed mounting screws, easy installation, and aesthetic appeal.

BACKGROUND OF THE INVENTION

Deadbolt lock mechanisms for doors normally include an operating handle either in the form of a knob or of a thumbturn. A user rotates the thumbturn using a thumb and finger placed on opposite sides of a central bar portion of the thumbturn. In a conventional single cylinder deadbolt lock mechanism, an oscillating crank actuates a bolt which selectively engages a strike plate on a door frame within which the door is closed. The crank is provided with a thumbturn extending from one side of the door for operating the bolt. The thumbturn is mounted for rotation in a plate or rose body secured to the door panel. The rotation of the thumbturn is required to extend or retract the deadbolt latch into or out of a faceplate guide assembly that is installed in a clearance hole. This is accomplished by coupling the thumbturn to the deadbolt latch using a driver bar or other linkage. Therefore, a mechanical link is created so that when the thumbturn is rotated, the driver bar acts to operate the movement of the deadbolt latch.

The typical thumbturn is made by forming a somewhat yieldable planar sheet of metallic material into an approximately elliptical central portion having a pair of tabs extending from the opposite sides of the central portion. The central portion is then drawn into a cup, leaving the tabs in their original planar position. The tabs are then curved into semi-cylindrical shape facing in the same direction. Finally the tabs are moved into a position concentric with an axis normal to the original plane. The ends of the tabs are notched forming lugs. The tabs of the thumbturn are inserted into the hub of the rose body. A cap is placed over the end of the hub. The cap has apertures through which the lugs are inserted and extend through. The thumbturn is rotatably secured to the rose body by bending, or splaying the lugs, thereby forcing the cap against the hub and forcing the bottom of the thumbturn against the bearing ring of the rose body.

There are several problems associated with these type of thumbturn assemblies. One problem is that the lugs can become loose causing rattling and potentially allowing the thumbturn to disconnect from the rose body. Another problem is the durability, or structural strength of the thumbturn which is generally made from a yieldable sheet of metallic material. Still another problem is that the thumbturn must be formed in a series of bending and forming steps which add to the cost and cycle time of the manufacturing process.

Therefore, there remains a need in the art for a thumbturn assembly that can be satisfactorily secured within a rose body housing over an extended period of time without becoming loose or rattling. There also remains a need in the art for a high strength thumbturn assembly that can be manufactured easily and economically and provide for simple installation.

SUMMARY OF THE INVENTION

The present invention solves the problems encountered by the prior art by securely coupling the thumbturn assembly to the inside housing of the deadbolt in a unique a and novel manner which extends the life and durability of the thumbturn assembly.

The present invention is a deadbolt thumbturn assembly for attachment to an inside housing of the deadbolt assembly. The deadbolt thumbturn assembly comprises a thumbturn, a bushing collar, and a rose body. The bushing collar is rotatably attached to an extension portion of the thumbturn. The rose body includes an aperture wherein the bushing collar is rotatably attached to the rose body. Finally, the bushing collar is fixably attached to the inside housing of the deadbolt assembly such that rotation of the thumbturn actuates and deactuates the deadbolt assembly. The method of attaching a thumbturn assembly to a deadbolt assembly of the present invention comprises the steps of inserting an extension of a thumbturn into a collar bushing and attaching them together such that the thumbturn extension is able to rotate within the collar. The collar bushing is then inserted into an aperture of a rose body and attached thereto such that the collar bushing is able to rotate within the rose body aperture to form a deadbolt thumbturn assembly. Finally, the collar bushing is fixably attached to a non-rotating portion of the deadbolt assembly so that rotation of the thumbturn actuates and deactuates the deadbolt.

DETAILED DESCRIPTION OF THE INVENTION

Figure 1:
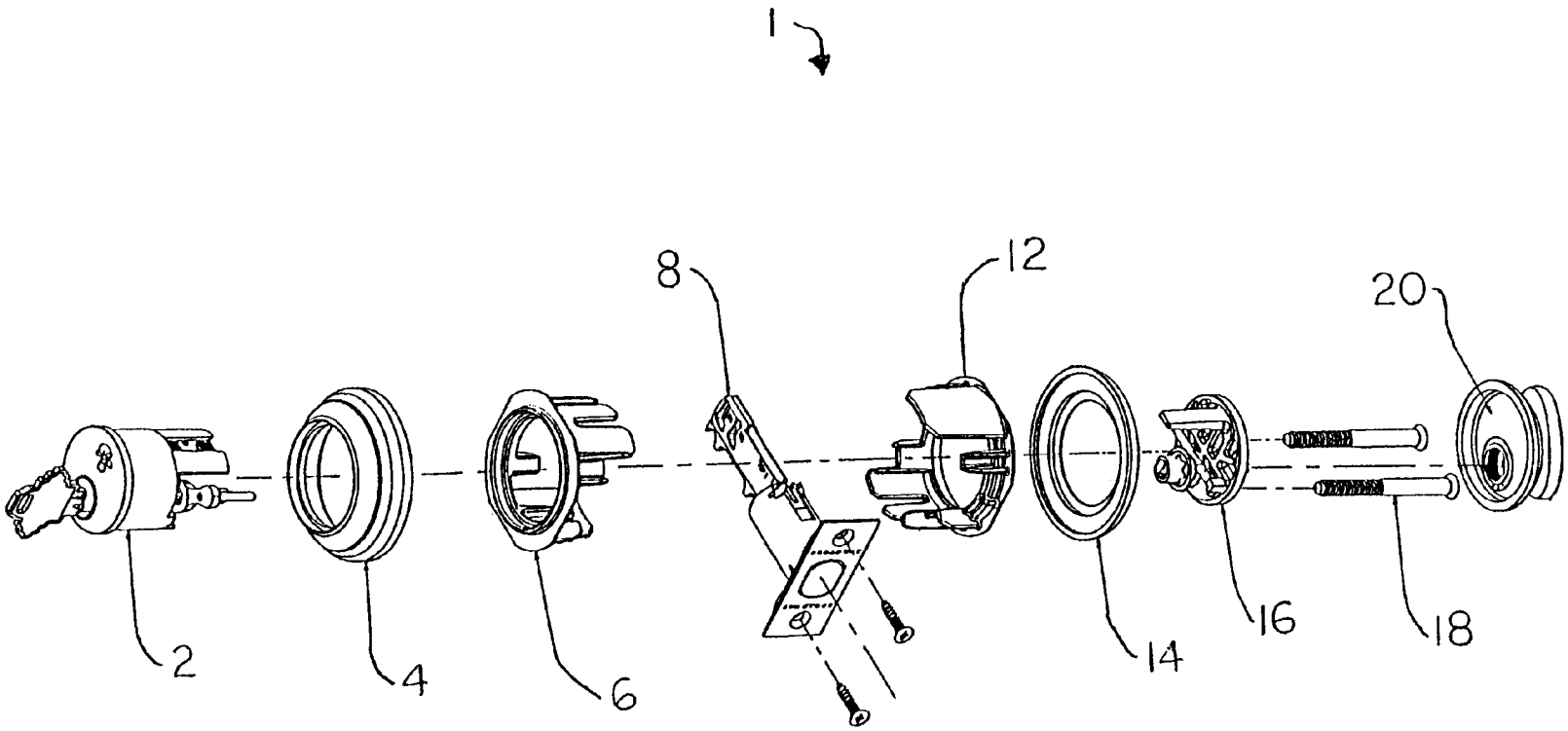
FIG. 1 is an exploded perspective view of a single cylinder deadbolt lock.

FIG. 1 shows the typical make up of a single cylinder deadbolt lock 1. The single cylinder deadbolt lock 1 consists of an outside cylinder housing 2 connected to an outside spin ring 4, which is then connected to an outside impact resistant cylinder shell 6. The outside cylinder shell 6 is secured to the cross bore of a door, not shown. Deadbolt latch 8 is set in the side bore of the door and secured. Further, an inside impact resistant cylinder shell 12 is set in the cross bore of the door on the opposite side of the outside impact shell 6. The inside impact shell 12 is connected to an inside spin ring 14, which is connected to the inside cylinder housing 16. Two mounting screws 18 are used to align and fasten the single cylinder deadbolt lock 1 together. The components as shown are an example of a single cylinder deadbolt lock, but other typical single cylinder deadbolt lock mechanisms are also usable in accordance with the invention. The remaining element shown is thumbturn assembly 20 of the present invention, which is then coupled to the inside housing 16 as will be described in more detail below.

Figures 2, 3:
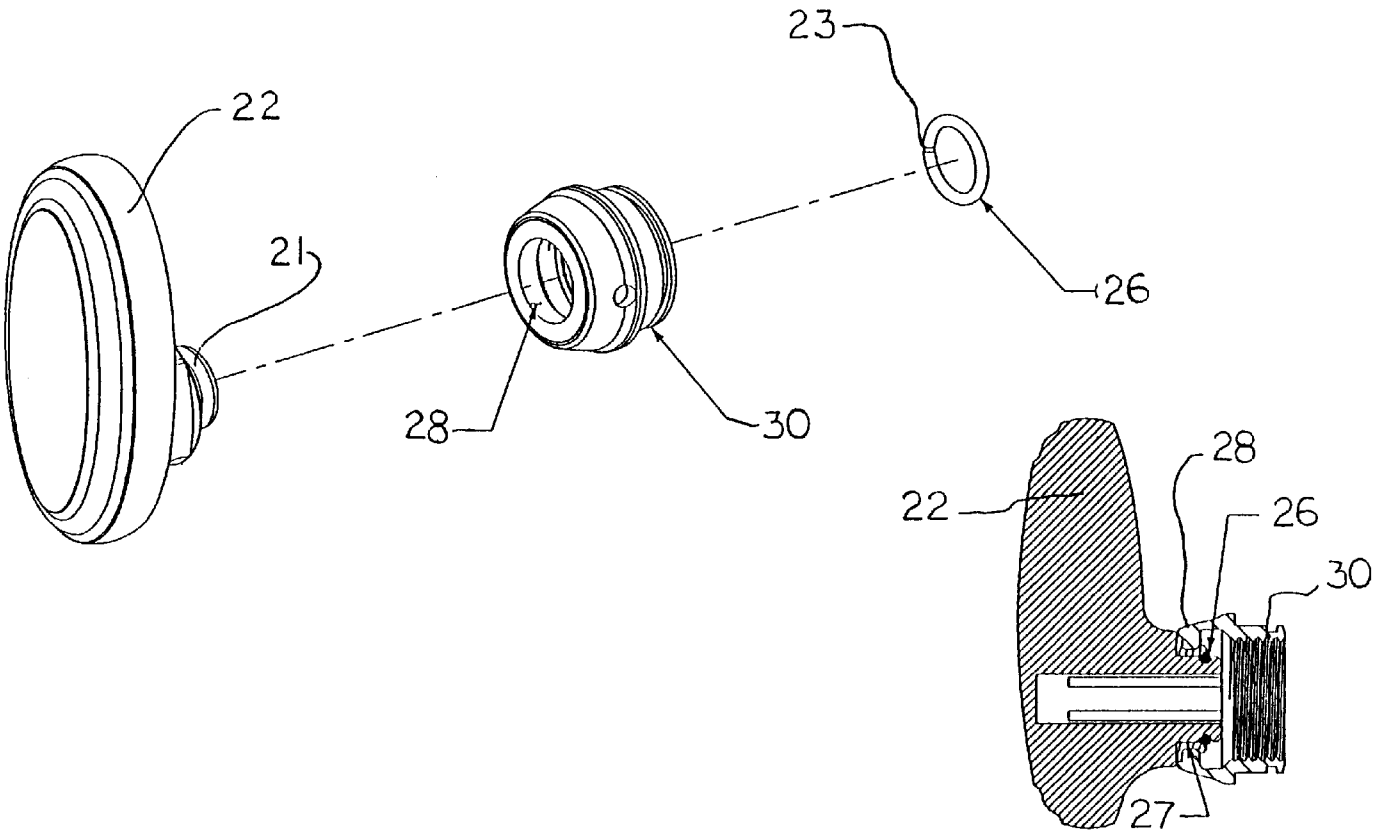
FIG. 2 is an exploded perspective view of the thumbturn and bushing which are a part of the present invention.
FIG. 3 is a side elevational view in cross-section of the thumbturn assembly of the present invention.

Referring to FIG. 2, thumbturn 22 is attached to a bushing collar 30 and a rose bearing 28 by retaining ring 26 such that thumbturn 22 can rotate within bushing collar 30. FIG. 3 depicts how thumbturn 22 and bushing collar 30 and rose bearing 28 are coupled. The rose bearing 28 snaps into the non-threaded end of bushing collar 30. The thumbturn 22 includes a thumbturn extension 21, which is inserted through the rose bearing 28 and bushing collar 30. The thumbturn is retained in the bushing collar 30 by a retaining ring 26 which fits into a groove on thumbturn extension 21 while also registering against rose bearing 28 on the inside of bushing collar 30. The retaining ring 26 retains thumbturn 22 securely in place and also allows it to rotate within the bushing collar 30.

Figure 4:
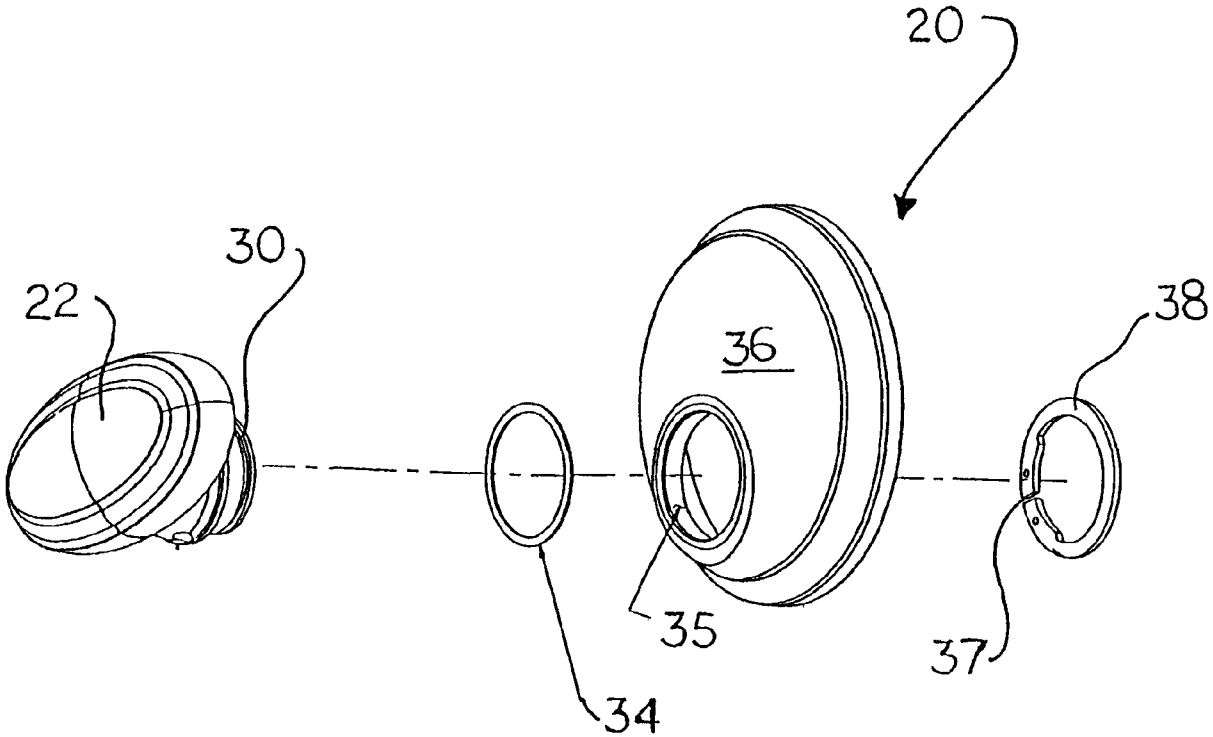
FIG. 4 is an exploded perspective view of the rose and bushing incorporated into the present invention.

FIG. 4 depicts how the assembled thumbturn 22 and bushing collar 30 combination is attached to deadbolt rose 36 to form thumbturn assembly 20. Washer 34 is inserted over the bushing collar 30 to separate the bushing collar from deadbolt rose 36. The bushing collar 30 is then inserted into aperture 35 of deadbolt rose 36. A retaining ring 38 is then inserted over the end of bushing collar 30 into a mating slot in the end of bushing collar 30. The retaining ring 38 securely attaches the assembled thumbturn 22 and bushing collar 30 combination to deadbolt rose 36 to form thumbturn assembly 20 in a manner such that the thumbturn 22 is still allowed to rotate within the bushing collar 30.

Figure 6:
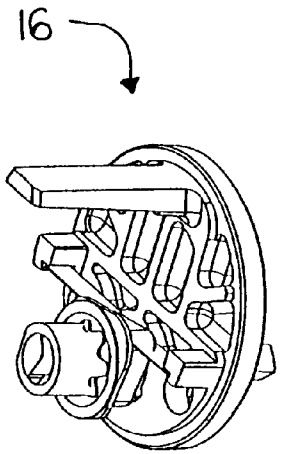
FIG. 6 is a perspective view of the inside housing of a single cylinder deadbolt lock.
Figure 5:
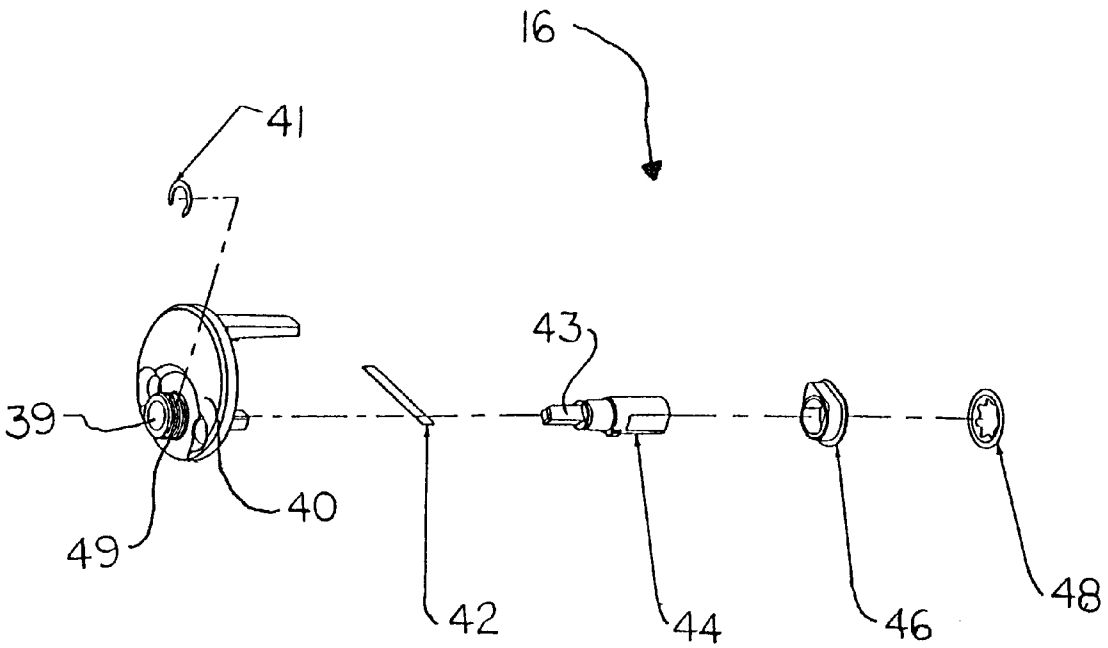
FIG. 5 is an exploded perspective view of the inside housing of a single cylinder deadbolt lock.

The thumbturn assembly 20 is then coupled to the inside housing 16. Referring to FIG. 5, the inside housing 16 is assembled by placing the extension 43 of the deadbolt actuator 44 through an aperture 39 in the threaded boss 49. A small retaining clip 41 is used to secure the deadbolt actuator 44 to the inside housing 16. The flat spring 42, deadbolt cam 46, and push-on nut 48 are attached to complete the inside housing 16. FIG. 6 further shows the fully assembled inside housing 16. The inside housing 16 is assembled to the rest of deadbolt lock 1 by a pair of screws 18 as depicted in FIG. 1. The thumbturn assembly 20 is then attached to inside housing 16 by fastening interior threads in the bushing collar 30 of the thumbturn assembly 20 to the exterior threads of threaded boss 49 of the inside housing 16. The threaded connection securely fastens the thumbturn assembly 20 to the inside housing 16 such that the deadbolt rose 36 covers the ends of screws 18 thus adding to the aesthetic value of the deadbolt lock 1. The alignment of the thumbturn 22 is accomplished by a receptacle 27 in the thumbturn 22 which aligns to the extension 43 of the deadbolt actuator 44. This final assembly links the thumbturn 22 to the deadbolt latch 8 via the deadbolt actuator 44.

The design of the thumbturn assembly 20 allows for attachment to the inside housing 16 and still allows rotation of the thumbturn 22 to extend or retract the deadbolt 8. This is accomplished by the bushing collar component 30. The collar component 30, is threaded internally to fasten to the threaded boss 49 of the face of the inside housing 40 and, when assembled, still allows for rotation of the thumbturn 22. This is accomplished by the retaining ring 26 which fits into the extension 21 of the thumbturn 22 and interfits to the inside of the bushing collar 30.

This novel approach for securing the thumbturn assembly 20 to the inside housing 16 allows the design to use all forged material in the manufacture of the thumbturn, making a more aesthetically pleasing appearance and feel for the user. In another embodiment, the design can use all cast material in the manufacture of the thumbturn. The design also allows for thicker material to be used in the outside construction for increased structural integrity. The invention provides easy installation, and also conceals the mounting screws which allows for a cleaner and more aesthetic design.

Although the principles, preferred embodiments and preferred operation of the present invention have been disclosed in detail herein, this is not to be construed as being limited to the particular illustrative forms disclosed. It will thus become apparent to those skilled in the art that various modifications of the preferred embodiments herein can be made without departing from the spirit or scope of the invention as defined by the appended claims.

What is claimed is:

1. A deadbolt thumbturn assembly for attachment to an inside housing of a deadbolt assembly, the deadbolt thumbturn assembly comprising:

a thumbturn having a thumbturn extension;

a bushing collar attached to said inside housing of said deadbolt assembly;

a rose bearing attached to said bushing collar; and a rose body having an aperture wherein said bushing collar is rotatably attached to said rose body;

wherein said thumbturn is rotatably attached against said rose bearing inside said bushing collar; and wherein rotation of said thumbturn actuates and deactuates said deadbolt assembly.

2. The deadbolt thumbturn assembly as recited in claim 1, wherein said thumbturn is made of a solid metallic material.

3. The deadbolt thumbturn assembly as recited in claim 1, wherein said thumbturn is made of forged materials.

4. The deadbolt thumbturn assembly as recited in claim 1, wherein said thumbturn is made of cast materials.

5. The deadbolt thumbturn assembly as recited in claim 1, wherein said thumbturn extension is rotatably attached to said bushing collar by a retaining ring.

6. The deadbolt thumbturn assembly as recited in claim 1, wherein said bushing collar is rotatably attached to said rose body by a retaining ring.

7. The deadbolt thumbturn assembly as recited in claim 1, wherein said bushing collar is separated from said rose by a washer.

8. The deadbolt thumbturn assembly as recited in claim 1, wherein said thumbturn includes a receptacle which mates with a deadbolt actuator of said deadbolt assembly such that rotation of said thumbturn causes rotation of said deadbolt actuator, thereby engaging and disengaging said deadbolt.

9. The deadbolt thumbturn assembly as recited in claim 1, wherein said bushing collar includes internal threads which matingly connect to external threads of a threaded boss of said inside housing, thereby attaching said thumbturn assembly to said inside housing.

10. A deadbolt thumbturn assembly for attachment to a deadbolt assembly of a door comprising:

a thumbturn having a thumbturn extension and means for engaging a driver bar of said deadbolt assembly;

a collar bushing rotatably attached to said thumbturn extension;

a rose body having an aperture wherein said collar bushing is inserted therein and rotatably attached thereto;

wherein said collar bushing is fixably attached to a portion of said deadbolt assembly such that rotation of said thumbturn causes rotation of said driver bar and actuation and deactuation of said deadbolt assembly.

11. A method of attaching a deadbolt thumbturn assembly to a deadbolt assembly comprising the steps of:

a) attaching a rose bearing into a collar bushing;

b) inserting an extension of a thumbturn into said collar bushing and said rose bearing;

c) attaching said extension of said thumbturn against said rose bearing and inside said collar bushing such that said thumbturn extension is able to rotate within said collar bushing;

d) inserting said collar bushing into an aperture of a rose body;

e) attaching said collar bushing to said rose body such that said collar bushing is able to rotate within said rose body aperture to form a deadbolt thumbturn assembly; and f) fixably attaching said collar bushing to a non-rotating portion of said deadbolt assembly such that rotation of said thumbturn actuates and deactuates said deadbolt.

12. The method of attaching a deadbolt thumbturn assembly to a deadbolt assembly as recited in claim 11 further comprising the step of:

f) aligning a receptacle in said thumbturn with the extension of the deadbolt actuator.

* * * * *